US011945615B2

(12) United States Patent
Brioschi

(10) Patent No.: US 11,945,615 B2
(45) Date of Patent: Apr. 2, 2024

(54) BAG APPLICATOR ASSEMBLY FOR A STATIONARY PACKER ASSEMBLY FOR FILLING VALVE BAGS, STATIONARY PACKER ASSEMBLY COMPRISING THIS BAG APPLICATOR ASSEMBLY AND METHOD FOR OPERATING THIS BAG APPLICATOR ASSEMBLY

(71) Applicant: FLSmidth A/S

(72) Inventor: Sergio Brioschi, Sulbiate (IT)

(73) Assignee: FLSmidth A/S (DK)

( * ) Notice: Subject to any disclaimer, the term of this patent is extended or adjusted under 35 U.S.C. 154(b) by 275 days.

(21) Appl. No.: 17/607,456

(22) PCT Filed: May 1, 2020

(86) PCT No.: PCT/IB2020/054134
§ 371 (c)(1),
(2) Date: Oct. 29, 2021

(87) PCT Pub. No.: WO2020/222185
PCT Pub. Date: Nov. 5, 2020

(65) Prior Publication Data

US 2022/0219853 A1 Jul. 14, 2022

(30) Foreign Application Priority Data

May 1, 2019 (DK) ..... PA 2019 00526

(51) Int. Cl.
*B65B 43/26* (2006.01)
*B65B 1/18* (2006.01)
*B65B 43/18* (2006.01)

(52) U.S. Cl.
CPC ..... *B65B 43/262* (2013.01); *B65B 1/18* (2013.01); *B65B 43/18* (2013.01)

(58) Field of Classification Search
CPC ..... B65B 1/18; B65B 43/16; B65B 43/18; B65B 43/262; B65B 43/465
(Continued)

(56) References Cited

U.S. PATENT DOCUMENTS 3,691,715 A * 9/1972 Kelly et al. ..... B65B 43/262 53/459
4,141,392 A * 2/1979 Moltrasio ..... B65B 43/262 141/68
(Continued)

FOREIGN PATENT DOCUMENTS

DE 2514954 B * 6/1976 ..... B65B 43/262
DE 2462347 A1 12/1976
(Continued)

OTHER PUBLICATIONS

International Search Report and Written Opinion dated Nov. 5, 2020, 15 pages.

*Primary Examiner* — Stephen F. Gerrity
(74) *Attorney, Agent, or Firm* — Jeffrey A. Sharp

(57) ABSTRACT

A bag applicator assembly for a stationary packer assembly comprising a plurality of filling nozzles for filling valve bags wherein a valve bag comprising a valve selectively movable between a closed and an open configuration; the bag applicator comprising: a bag feeding device comprising a supporting plane configured for receiving a valve bag having the valve in a closed configuration; a valve opening device configured for cyclically moving between a first configuration of keeping the valve bag from the supporting plane and a second configuration of opening the valve and keeping the valve in the open configuration; a bag applicator device configured for picking up the valve bag from the valve opening device, for travelling from the valve opening device to a filling nozzle in a travelling configuration for avoiding
(Continued)

bag interference with the filling nozzles and for releasing the bag at the filling nozzle.

8 Claims, 7 Drawing Sheets

(58) Field of Classification Search
USPC ..... 53/459, 570, 571, 573, 386.1; 141/68
See application file for complete search history.

(56) References Cited

U.S. PATENT DOCUMENTS

| | | | | | |
|---|---|---|---|---|---|
| 4,577,454 | A | | 3/1986 | Wright et al. | |
| 5,050,651 | A | * | 9/1991 | Hejlesen | B65B 43/262 53/573 |
| 5,054,275 | A | | 10/1991 | Brormann | |
| 2007/0051425 | A1 | * | 3/2007 | Wadium et al. | B65B 43/465 141/166 |
| 2008/0256905 | A1 | | 10/2008 | Graf | |
| 2012/0192527 | A1 | | 8/2012 | Manzon et al. | |

FOREIGN PATENT DOCUMENTS

| | | | | | |
|---|---|---|---|---|---|
| GB | 1436131 | A | * | 5/1976 | B65B 43/262 |
| GB | 1555930 | A | * | 11/1979 | B65B 43/262 |
| GB | 1558143 | A | * | 12/1979 | B65B 43/262 |
| GB | 2265596 | A | * | 10/1993 | B65B 43/262 |

* cited by examiner

BAG APPLICATOR ASSEMBLY FOR A STATIONARY PACKER ASSEMBLY FOR FILLING VALVE BAGS, STATIONARY PACKER ASSEMBLY COMPRISING THIS BAG APPLICATOR ASSEMBLY AND METHOD FOR OPERATING THIS BAG APPLICATOR ASSEMBLY

FIELD OF THE INVENTION

The present invention relates to the technical field of filling valve bags with powder or granulated products, in particular cement for cement industry, building materials, fertilizers and chemicals products. More in detail, the present invention refers to a bag applicator for a "stationary" packer assembly comprising a plurality of stationary filling nozzles. The present invention moreover refers to a stationary packer assembly comprising this bag applicator and a method for operating this bag applicator.

DESCRIPTION OF PRIOR ART

In the cement industry, particular machines called packer assemblies are used. In particular, a packer assembly is an automatic machine configured for manipulating and filling valve bags. A valve bag is a bag, i.e., a rectangular shaped tube of paper or plastic, having a rear face and a front face (where usually an indication of the content is provided) wherein each face is defined by two opposite long sides, two opposite short sides and two opposite ends closed by glue or a sewing. Since the empty valve bags are stored in pressed stacks, it is immediately clear which side is the long side. In a valve bag, a corner between a long side and a short side is provided with a valve in the form of an open folded edge portion of the bag. In view of the above configuration, when the bag is in a pressed condition (i.e., pressed face to face), the valve is considered as closed even if the folded edge portions of the opposite faces are not physically bounded to each other. Since the valve bags are fed to the packer assembly in this pressed condition, before the filling operations, it is important to preliminarily open the valve before the filling operations begin. This preliminary opening step is performed by a device called a valve opening device. Usually, the valve opening device is provided by a spreading device configured for spreading an empty or pressed bag at the valve in order to move the valve from the closed configuration to an open configuration. In the open configuration, the folded edge portions of the valve (that was previously resting one on top of the other in pressed configuration) are physically spaced from each other to define an opening that is substantially rhombus-shaped.

Starting from the above general definition of the valve bag and the valve opening device, a bag applicator of a stationary packer assembly comprises:

- a bag feeding device comprising a supporting plane configured for receiving the valve bag having the valve in a closed configuration;
- the valve opening device configured for picking up each valve bag from the supporting plane for opening the valve of the valve bag and for keeping the valve in the open configuration; and
- a bag applicator device configured for picking up the valve bag from the valve opening device with the valve in the open configuration, travelling with the valve bag from the valve opening device to any one of a plurality of filling nozzles of the stationary packer assembly by keeping the valve in the open configuration and releasing the bag at the selected filling nozzle with the filling nozzle at least partially inserted into the valve in the open configuration.

In cases where the valve opening device is presented with a stack of valve bags by the supporting plane, the valve opening device is configured for picking up a single valve bag from the stack before opening the valve.

Upstream of the bag feeding device, the bag applicator assembly may also comprise a bag storage configured for being supplied with a plurality of stacks of valve bags or with the plurality of single valve bags and for feeding the valve bags to the bag feeding device.

Downstream of the filling nozzles, the bag applicator assembly may comprise a delivery device, for instance a conveyor belt, configured for receiving the filled bag and for moving these filled bags away from the packer assembly.

According to the prior art, the valve opening device comprises two suction devices configured for acting on two opposite portions of a bag, namely the valve portion and the opposite closed end. These suction devices, or at least one of them, are configured for preliminary coupling with the bag and for lifting (just a few mm) the bag from the stack. In this condition, the suction device acting on the valve is configured for performing a relative movement with respect to the other suction device. Due to this movement the bag is spread, and the valve is consequently opened. According to the prior art, the bag applicator device comprises a moving arm provided at its free end with a clamping device configured for picking up the valve bag from the valve opening device and for releasing the bag at a filling nozzle. The movement from the valve opening device to the filling nozzles and vice-versa may be defined as a travelling movement parallel to the disposition of the filling nozzles one beside the other. In order to avoid any impact between the moving arm and the filling nozzles, the linear movement is performed by keeping the arm at a certain distance from the filling nozzles. Once the arm reaches a filling nozzle, the arm is configured to stop its linear or travelling movement and perform an approaching movement towards the nozzle. After releasing the bag at the filling nozzle, the arm is configured to move away from the filling nozzle (by a movement opposite to the above approaching movement), in order to reach a safe distance from the filling nozzles. At the valve opening device, the arm is configured for performing similar movements involved at the filling nozzle, i.e. an approaching movement for reaching the bag (kept open by the valve opening device) and a moving away movement for reaching a safe distance from the nozzles in view of the coming linear/travelling movement. Therefore, a working cycle of the above-described bag applicator arm may be accomplished by the following steps:

- clamping the open bag at the valve opening device;
- performing an away movement (for instance an arm rotation (about 60° CCW)) to avoid bag interference during the next linear movement or travelling to the filling nozzles;
- performing a linear/travelling movement from the valve opening device to a filling nozzle;
- performing an approaching movement to the filling nozzle (for instance an arm rotation (about 60° CW));
- performing an away movement from the filling nozzle (for instance an arm rotation (about ° CCW));
- performing a linear movement from the filling nozzle to the valve opening device;

performing an approaching movement to the valve opening device for reaching an open bag, kept open by the valve opening device (for instance an arm rotation (about 60° CW)).

Therefore, currently seven steps in succession are needed, wherein each step requires time to complete an entire time cycle. Unfortunately, this arm time cycle represents a limit for the packer hourly capacity. For instance, an inline packer having four filling stations wherein each filling station has a capacity from 350 to 400 bags/h could reach theoretic capacity of 1400 to 1600 bags/h for the entire packer. However, the actual capacity is limited to 1200 bags/h due to the long arm time cycle explained above.

DISCLOSURE OF THE INVENTION

Accordingly, a primary object of the present invention is to provide a bag applicator assembly for a stationary packer assembly suitable for overcoming the problem as described above with respect to the prior art. In particular, the main purpose of the present invention is to provide a stationary packer assembly having a higher capacity, i.e. a capacity limited by the capacity of the filling operations and not by the bag applicator device time cycle.

According to a first aspect of the invention, a bag applicator assembly for a stationary packer assembly for filling valve bags is provided. In particular, with the terms "valve bag" we refer to a bag in form of a rectangular shaped tube having a front and a rear face and wherein each face is defined by two opposite long sides, two opposite short sides and two opposite ends closed by glue or a sewing. A valve is provided at a corner between a long side and a short side in the form of folded edge portions of the bag itself. By spreading the bag, the valve is movable from a closed to an open configuration wherein in the open configuration, the edge portions of the opposite faces of the valve bag are separated. The valve bags used in the present invention are the valve bags currently available.

The bag applicator assembly for the stationary packer assembly comprises:

- a feeding device comprising a supporting plane (preferably movable/adjustable in vertical direction) configured for receiving the valve bag or a stack of valve bags having the valve in a closed configuration (i.e. the bags or the stacks of bags are fed having a face parallel to the supporting plane);
- a valve opening device configured for cyclically moving between a first configuration wherein it picks up the valve bag from the supporting plane and a second configuration wherein the valve has been opened and kept in the open configuration.
- a bag applicator device configured for picking up the valve bag from the valve opening device, travelling from the valve opening device to a filling nozzle of the packer assembly in a travelling configuration for avoiding bag interference with the filling nozzles and releasing the bag at the filling nozzle.

Starting from this well-known structure, according to the main aspect of the invention, in the second configuration, the valve opening device is in a position so that the bag applicator device can pick up the valve bag in the travelling configuration without requiring any additional approaching movement.

Preferably, the valve opening device is configured for cyclically moving from a first or lower position to a second or raised position with respect to the supporting plane wherein, in the lower position the valve opening device is in the first configuration and in the raised position the valve opening device is in the second configuration. The purpose of this raised configuration is clear with respect to an aspect of the bag applicator assembly, i.e., the movement of the valve bags by the bag applicator device from the valve opening device to the filling nozzles. Advantageously, the raised position of the valve opening device allows to reduce the working cycle of the bag applicator device because once the bag applicator device arrives at the valve opening device, the bag applicator device can pick up an open valve bag without any delay and any additional approaching movement required. According to different embodiments, the valve opening device can be configured for reaching the second configuration before the raising movement, during the raising movement or after the raising movement, provided that when the bag applicator device arrives at the valve opening device, the valve bag is ready for being picked up.

The actuation of the raising movement of the valve opening device may be realized in many different ways. In the following descriptions of the drawings a solution will be described wherein the valve opening device has been housed in a tilting supporting frame moving with respect to the supporting plane.

As mentioned above, the stationary packer assembly of the present invention is also referred to as an inline packer comprising a bag applicator assembly. The inline packer comprises:

- a plurality of stationary filling nozzles, preferably arranged one beside the other along a linear/straight direction, wherein each filling nozzle is configured to enter the valve in the open configuration for delivering a powdery material into the bag.

Due to the presence of the bag applicator assembly of the present invention, the raised position of the valve opening device is in such a position that when the bag applicator device reaches the valve opening device, it can pick up the valve bag directly in the travelling configuration without any additional approaching movement required.

The bag applicator device may be realized in different ways. In the following description of the drawings an embodiment will be described wherein the bag applicator device comprises a tilting arm running along a guide (preferably, a linear guide) and provided with a clamping device at a free end.

The present invention also refers to a method for operating the foregoing described bag applicator assembly. In particular, the main feature of this method is controlling the raising movement of the valve opening device so that when the bag applicator device reaches the valve opening device, the valve bag can be picked up by the bag applicator device without any delay and any additional movement required to change from the travelling condition. With reference to the prior art, the operating steps that include the away movement of the bag applicator device from the valve opening device and the approaching movement of the bag applicator device towards the valve opening device are no longer necessary in accordance with the present invention.

In the present context a number of terms are used in a manner being ordinary to the skilled person. Some of these terms are detailed below:

Travelling is preferably used to denote a movement of the valve bag from one position to another.

It is to be understood that both the foregoing general description and the following detailed description are exemplary and are intended to provide further explanation of the invention as Claimed. Other advantages and features of the invention will be apparent from the following description, drawings and claims.

The features of the invention believed to be novel are set forth with particularity in the appended claims.

BRIEF DESCRIPTION OF DRAWINGS

Further benefits and advantages of the present invention will become apparent after a careful reading of the detailed description with appropriate reference to the accompanying drawings.

The invention itself, however, may be best understood with reference to the following detailed description of the invention, which describes an exemplary embodiment of the invention, taken in conjunction with the accompanying drawings, in which.

DETAILED DESCRIPTION OF PREFERRED EMBODIMENTS OF THE INVENTION

In cooperation with attached drawings, the technical contents and detailed description of the present invention are described thereinafter according to preferred embodiments, being not used to limit its executing scope. Any equivalent variation and modification made according to appended claims is all covered by the claims of the present invention.

Reference will now be made to the drawings to describe the present invention in detail.

Figure 1A:
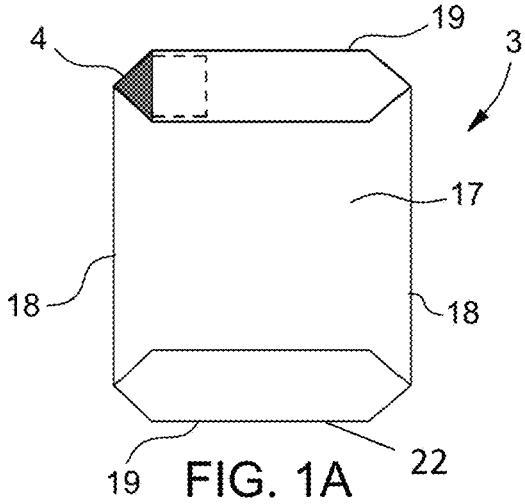
FIGS. 1*a* and 1*b* are schematic views of a kind of valve bag in an empty configuration and in a filled configuration, respectively.
Figure 1B:
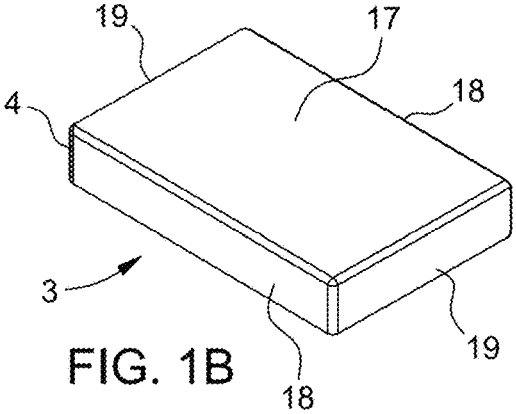

Reference is made to FIGS. 1*a* and 1*b*, which are schematic views of a kind of valve bag 3 for the present invention, in an empty configuration and in a filled configuration respectively. As known, this valve bag 3 is a bag in the form of a rectangular shaped tube having a front face 17 and a rear face and wherein each face is defined by two opposite long sides 18, and two opposite short sides 19 defining two opposite ends closed by glue or a sewing. A valve 4 is provided at a corner between the long side 18 and the short side 19 in form of folded edge portions of the valve bag 3. By spreading the valve bag 3, the valve 4 is movable between a closed and an open configuration wherein in the open configuration the edge portions of the opposite face are separated to form an opening connecting the interior space of the valve bag 3.

Figure 2:
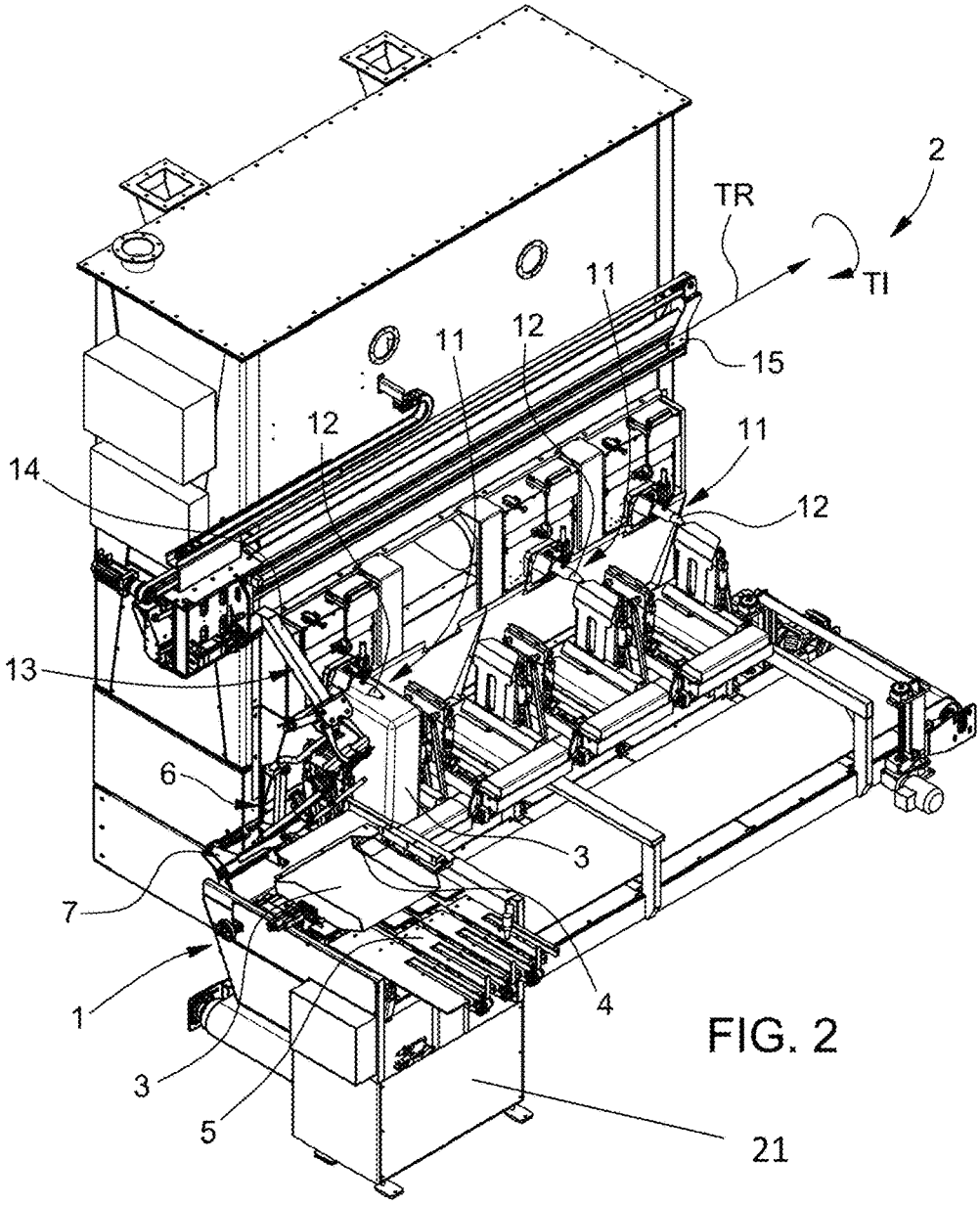
FIG. 2 is a schematic view of an inline packer according to the invention.

Reference is made to FIG. 2 which is a schematic view of an inline packer assembly 2 according to the present invention for filling the valve bag 3 of FIG. 1*a*. This inline packer assembly 2 is provided with a stationary packer comprising:

- an opening valve station 1 provided with a valve opening device 6;
- a bag applicator device 13;
- a plurality of filling stations 11 arranged one beside the other along a linear/straight direction wherein each filling station 11 is provided with a filling nozzle 12.

The disclosed opening valve station 1 is defined by a supporting plane 5 of a feeding device 21. The supporting plane 5 is configured for receiving a valve bag 3 or a stack of bags having the valve 4 in a closed configuration as represented. The supporting plane 5 may be movable/adjustable in vertical direction so that the valve bag 3 can be picked up and is always flush with the valve opening device 6. The valve opening device 6 is configured for cyclically moving between a first configuration and a second configuration. In the first configuration the valve opening device 6 is configured for picking up the valve bag 3 from the supporting plane 5 whereas in the second configuration the valve opening device 6 is configured for opening the valve 4 and keeping the valve 4 the open configuration.

Once open, the valve bag 3 is picked up by the bag applicator device 13 comprising a tilting arm 14. This tilting arm 14 is at one side connected to a linear guide 15 running along the filling stations 11 and at the opposite side is provided with a clamping device 16. The clamping device 16 is configured for picking up the valve bag 3 from the valve opening device 6 with the valve 4 in the open configuration. As known, this clamping device 16 is suitable for bringing the open valve bag 3, for keeping the valve 4 open during the movement along the guide 15 and for releasing the valve bag 3 at the filling station 11. During the travelling movement along the guide 15 between the opening valve station 1 and the filling stations 11, the tilting arm 14 (wherein the tilting axis of the tilting arm 14 is parallel to the guide 15) is in a travelling configuration (i.e., having a certain tilting angle) that is suitable for avoiding bag interference with the filling nozzles 12. At the filling station 11, the tilting arm 14 stops the travelling movement and starts an approaching movement by tilting towards the filling station 11 for releasing the valve bag 3 at the filling nozzle 12. In FIG. 2, the arrows TR and TI represent the travelling movement along the guide 15 and the approaching/tilting movement towards or away from the filling nozzles 12, respectively.

Figure 3:
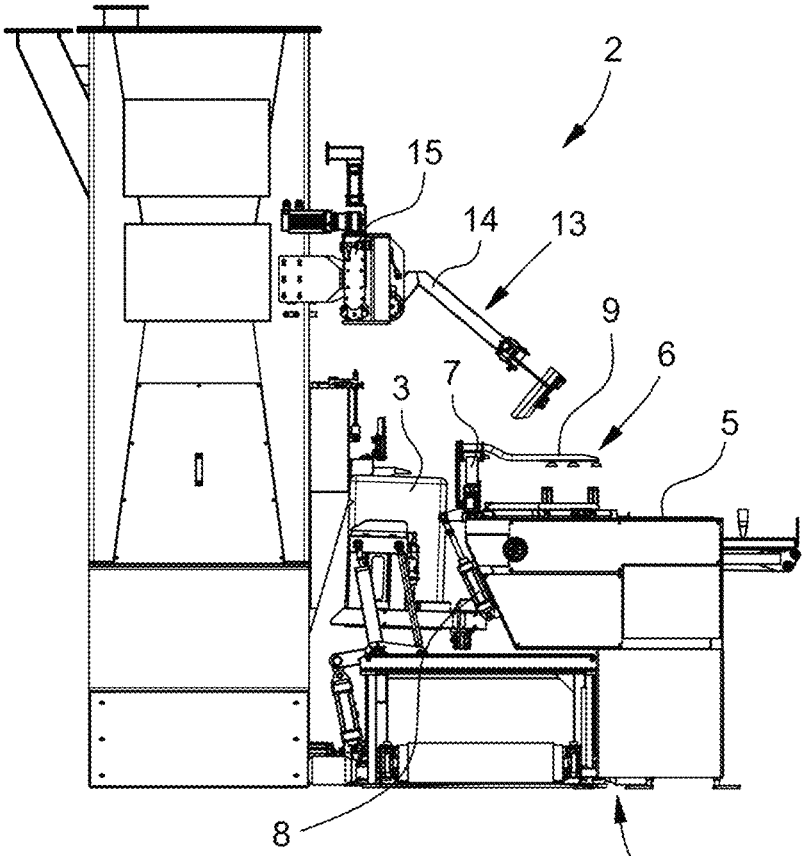
FIGS. 3 and 4 are schematic views of the inline packer of FIG. 2 in two different configurations.
Figure 4:
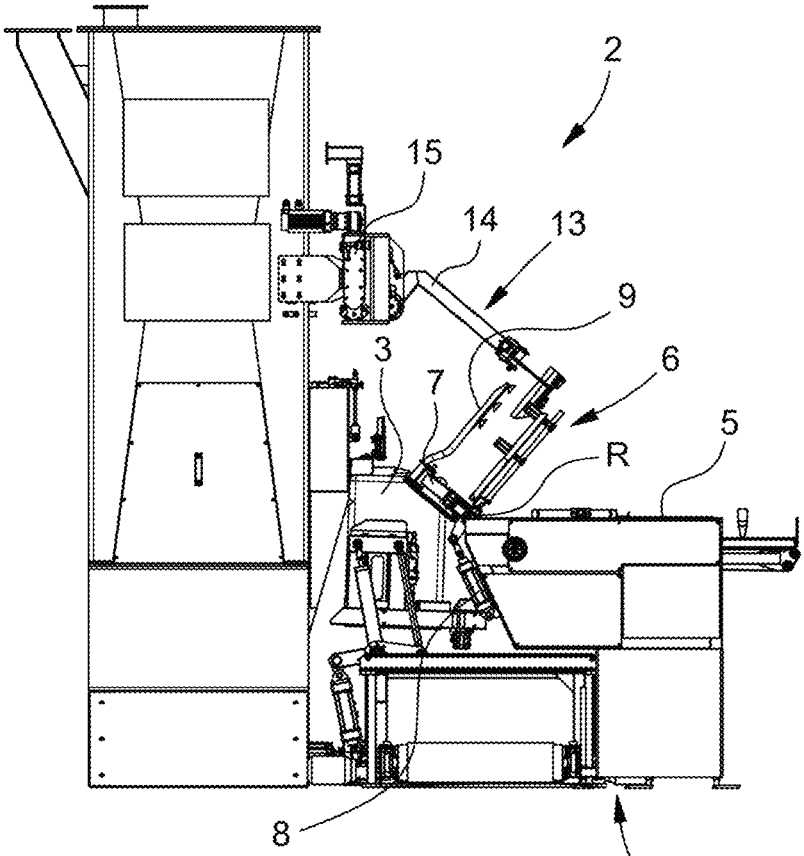

FIGS. 3 and 4 show the packer of FIG. 2 in two different configurations according to the present invention. FIG. 3 discloses the valve opening device 6 in a first or lower position with respect to the supporting plane 5. In this first or lower position, the valve opening device 6 is suitable for picking up a bag from the supporting plane 5. FIG. 4 discloses the valve opening device in a second or raised position with respect to the supporting plane 5. In particular, in this second or raised position the valve opening device 6 is in position so that the clamping device 16 of the tilting arm 14 can pick up the open valve bag 3 without any tilting movement starting from the travelling configuration. In particular, the valve opening device 6 reaches this raised position before the arrival of the tilting arm 14 at the opening station 1. In this example, the raised position is reached by a rotation of the valve opening device 6 about an axis (by a hinge connection) parallel to the guide 15. This rotation is driven by an actuator 8 as represented in FIGS. 3 and 4.

Figure 5:
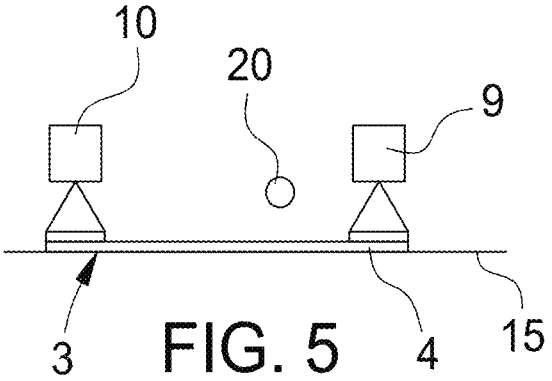
FIGS. 5-7 are schematic views of a valve opening device according to the present invention.
Figure 6:
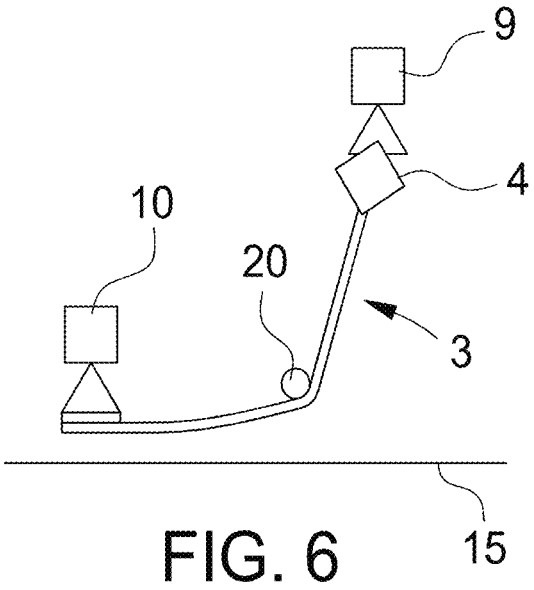
Figure 7:
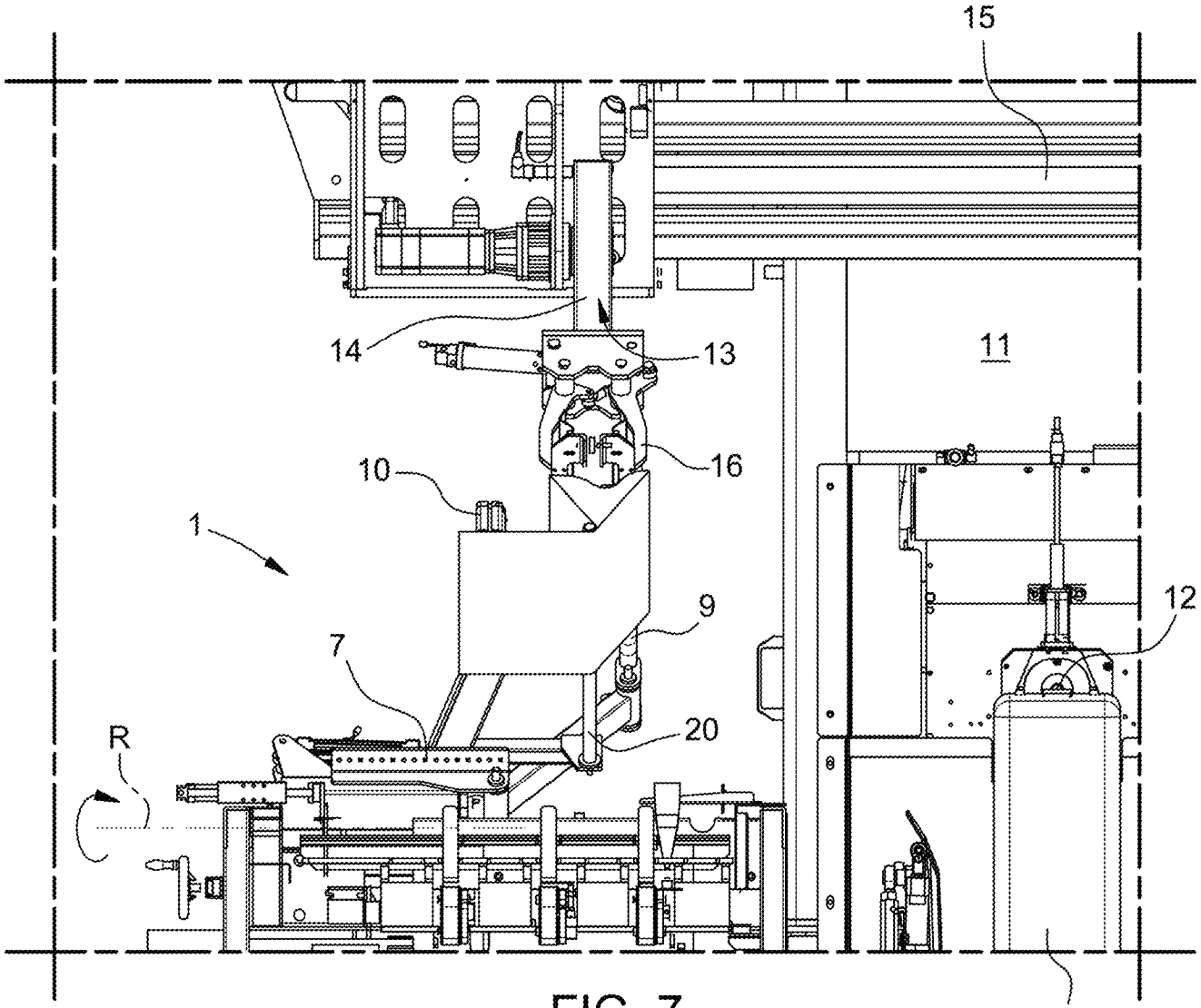

FIGS. 5-7 disclose an embodiment of the valve opening device 6 according to the invention. In particular, the valve opening device 6 comprises a supporting frame 7 pivotally connected with respect to the supporting plane 5. The supporting frame 7 supports a first suction device 9 configured for coupling with the valve bag 3 at the valve 4 and a second suction device 10 configured for coupling with the opposite end of the bag 3. FIG. 5 schematically represents the valve opening device 6 in the lower position with the first and second suction devices 9 and 10 acting on the closed valve bag 3. As represented in FIG. 6, the first suction device 9 is cyclically movable (i.e., tiltable around an axis orthogonal to the guide 15) with respect to the second suction device 10 for reaching a position wherein the valve bag 3 is spread and the valve 4 is open. The spread of the valve bag 3 is obtained by the presence of a fixed constraint 20 interacting with the valve bag 3 and positioned in between the two suction devices 9 and 10. According to the invention, when the valve opening device 6 reaches the configuration of FIG. 6 the tilting movement of the frame 7 is activated so that the open valve bag 3 reaches a raised position. Referring to FIG. 7, in this raised position the valve bag 3 can be picked up by the clamp 16 without requiring any approaching movement to the tilting arm 14 from the travelling condition.

Figure 8:
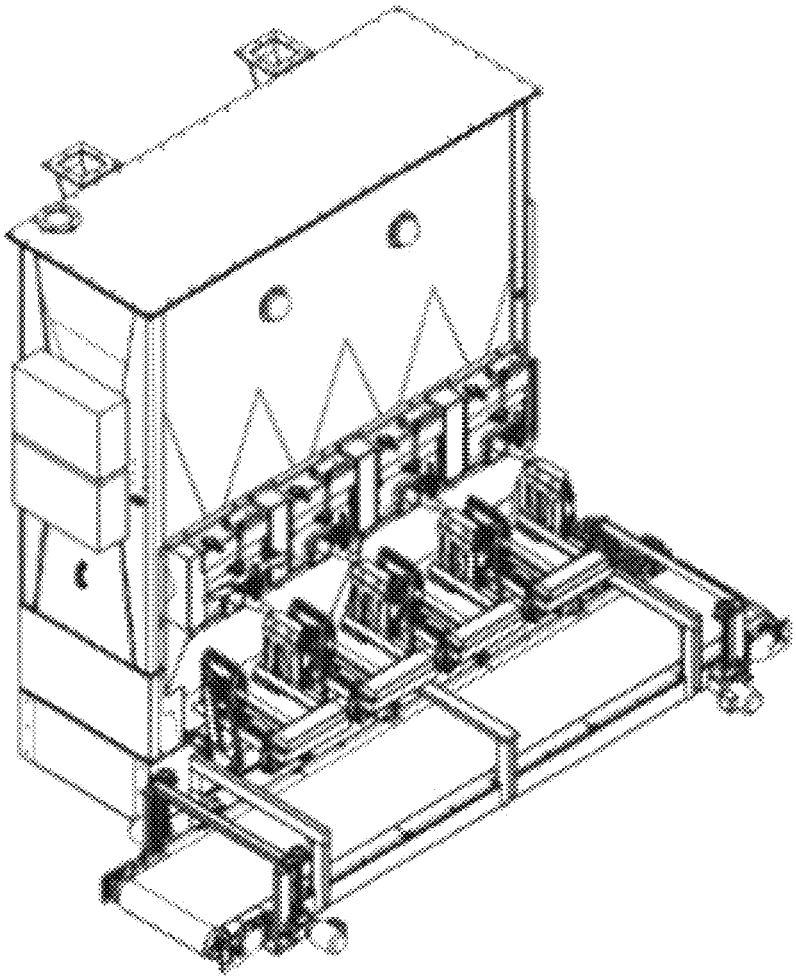
FIG. 8 is a schematic view of the inline packer according to the present invention.
Figure 9:
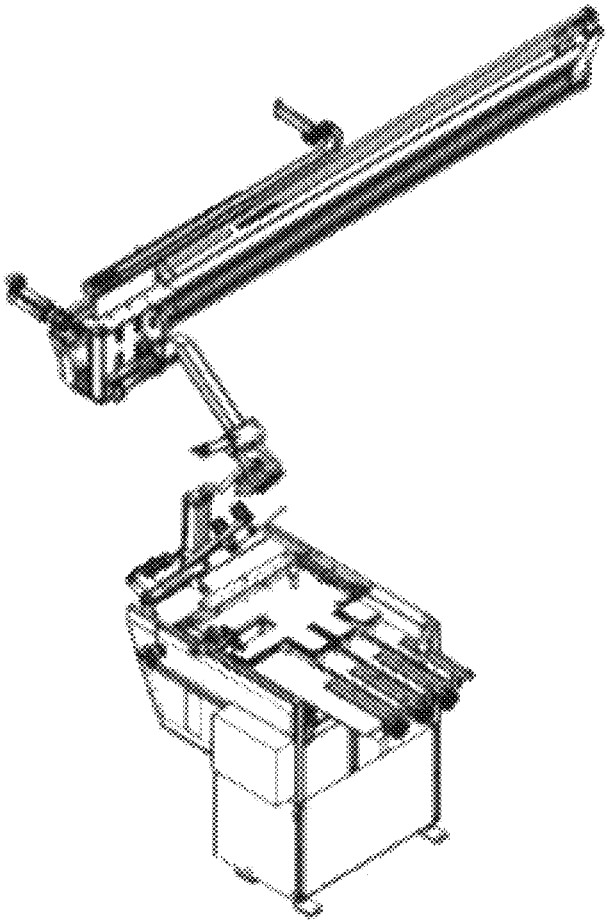
FIG. 9 is a schematic view of the inline bag applicator according to the present invention.

FIGS. 8 and 9 clarify the inline packer and the inline bag applicator depicted within FIG. 2 (FIG. 2 includes both the inline packer and the inline bag applicator).

FIG. 8 is a schematic view of the inline packer according to the present invention.

FIG. 9 is a schematic view of the inline bag applicator according to the present invention.

Although the invention has been explained in relation to its preferred embodiment(s) as mentioned above, it is to be understood that many other possible modifications and variations can be made without departing from the scope of the present invention.

Even if the main field of application of the present invention is the cement industry, a valve bag as foregoing described and the valve opening device of the present invention may be used in other technical field, for instance for filling the bags with building materials, fertilizers and chemicals products or also food.

It is, therefore, contemplated that the appended claim or claims will cover such modifications and variations that fall within the true scope of the invention.

The invention claimed is:

1. A bag applicator assembly for a stationary packer assembly (2) comprising a plurality of filling nozzles (12), arranged linearly, for filling valve bags (3), wherein each of the valve bags (3) comprises a valve (4) selectively movable between a closed and an open configuration; the bag applicator comprising:

a bag feeding device (21) comprising a supporting plane (5) configured for receiving the valve bag (3) having the valve (4) in the closed configuration;

a valve opening device (6) configured for cyclically moving between a first configuration of picking the valve bag (3) from the supporting plane (5) and a second configuration of opening the valve (4) and keeping the valve (4) in the open configuration, wherein the valve opening device (6) comprises:

a supporting frame (7) pivotably connected to the supporting plane (5), wherein:

in a lower position, the supporting frame (7) is parallel to the supporting plane (5); and in a raised position, the supporting frame (7) is tilted with respect to the supporting plane (5); and a bag applicator device (13) comprising a tilting arm (14) configured to pivot to switch between a travelling position and a releasing position, the bag applicator device (13) configured to:

pick up the valve bag (3) from the valve opening device (6), wherein the valve bag (3) is picked up from the valve opening device (6) when the supporting frame (7) is in the raised position, wherein the supporting frame (7) is tilted with respect to the supporting plane (5);

move the valve bag (3), linearly, towards a selected one of the filling nozzles (12) in a travelling configuration while avoiding valve bag (3) interference with the filling nozzles (12) wherein, in the travelling configuration, the tilting arm (14) is in the travelling position, thereby avoiding the valve bag (3) interference during liner movement past the filling nozzles (12); and release the valve bag (3) at the selected filling nozzle (12), by pivoting the tilting arm (14) to the releasing position;

wherein in the second configuration of the valve opening device (6), the bag applicator device (13) is configured to pick up the valve bag (3) in the travelling configuration without requiring the tilting arm (14) to change from the travelling position by virtue of the supporting frame (7) handing over the valve bag (3) in the raised position.

2. The bag applicator assembly as claimed in claim 1, wherein the valve opening device (6) comprises an actuator (8) configured for cyclically moving the supporting frame (7) from the lower position to the raised position and vice versa.

3. The bag applicator assembly as claimed in claim 1, wherein the supporting frame (7) supports:

a first suction device (9) configured to couple with the valve bag (3) at a first end (19) comprising the valve (4);

a second suction device (10) configured to couple with a second end (22) of the valve bag (3) that is disposed opposite to the first end (19) of the valve bag (3); and a fixed constraint (20) disposed between the first suction device (9) and the second suction device (10);

the first suction device (9) being cyclically movable with respect to the second suction device (10) between a first position wherein the valve bag (3) is not spread and the valve (4) is closed, and a second position wherein the valve bag (3) is spread and the valve is open (4), wherein the spread of the valve bag (3) is facilitated by the interaction of the fixed constraint (20) with the valve bag (3), causing the valve bag (3) to bend at the fixed constraint (20).

4. The bag applicator assembly as claimed in claim 1, wherein the tilting arm (14) is configured to:

selectively move along a linear/straight guide (15) from the valve opening device (6) to the filling nozzles (12), and vice versa; and tilt with respect to the linear/straight guide (15) between the travelling position and the releasing position at the filling nozzle (12).

5. The bag applicator assembly as claimed in claim 1, wherein the tilting arm (14) is provided with a clamping device (16) for picking up the open valve bag (3) at the valve opening device (6) and for releasing the valve bag (3) in a filling station (11).

6. The bag applicator assembly as claimed in claim 1, wherein the bag applicator comprises a control unit configured for controlling the movement of the valve opening device (6) from the lower to the raised position so that once the tilting arm (14) reaches the valve opening device (6), the valve bag (3) can be picked up by the tilting arm (14) without any delay.

7. The bag applicator assembly as claimed in claim 1, wherein:

each of the plurality of filling nozzles (12) is arranged one beside the other linearly, and each of the filling nozzles (12) is configured for entering the valve (4) in the open configuration of the valve bag (3) to deliver a powdery material inside the valve bag (3).

8. A method for operating the bag applicator assembly as claimed in claim 1, wherein the method comprises the steps of:

a) controlling the valve opening device (6) for cyclically moving from the first configuration to the second configuration and vice-versa;

b) controlling the bag applicator device (13) for cyclically performing the following steps:

picking up the open valve bag (3) at the valve opening device (6);

travelling linearly from the valve opening device (6) to one of the filling nozzles (12) in the travelling configuration;

changing from the travelling position to the releasing position for releasing the valve bag (3) at the filling nozzle (12);

changing from the releasing position to the travelling position by moving away from the filling nozzle (12) for reaching the travelling configuration; and travelling linearly from the filling nozzle (12) to the valve opening device (6) in the travelling configuration;

wherein, the steps a) and b) of controlling the valve opening device (6) and the bag applicator device (13) are performed so that when the bag applicator device (13) reaches the valve opening device (6), the valve opening device (6) is in the second configuration and the valve bag (3) can be picked up by the bag applicator device (13) in the travelling configuration without requiring the tilting arm (14) to change from the travelling position by virtue of the supporting frame (7) handing over the valve bag (3) in the raised position.

* * * * *